US011306504B2

(12) United States Patent
Aykas

(10) Patent No.: US 11,306,504 B2
(45) Date of Patent: Apr. 19, 2022

(54) FITTING WITH ADJUSTABLE RESTRAINING AREA

(71) Applicant: DORMA Deutschland GmbH, Ennepetal (DE)

(72) Inventor: Kenan Aykas, Ennepetal (DE)

(73) Assignee: DORMA-GLAS GMBH, Bad Salzuflen (DE)

( * ) Notice: Subject to any disclaimer, the term of this patent is extended or adjusted under 35 U.S.C. 154(b) by 763 days.

(21) Appl. No.: 14/946,079

(22) Filed: Nov. 19, 2015

(65) Prior Publication Data

US 2016/0194899 A1 Jul. 7, 2016

(30) Foreign Application Priority Data

Dec. 4, 2014 (EP) ..... 14196240

(51) Int. Cl.
*E05B 15/02* (2006.01)
*E05B 65/00* (2006.01)
*E05B 63/00* (2006.01)

(52) U.S. Cl.
CPC ..... *E05B 15/024* (2013.01); *E05B 15/0245* (2013.01); *E05B 63/006* (2013.01); *E05B 65/0025* (2013.01); *E05B 2015/0275* (2013.01); *Y10T 292/62* (2015.04); *Y10T 292/705* (2015.04); *Y10T 292/707* (2015.04)

(58) Field of Classification Search
CPC ..... Y10T 292/62; Y10T 292/705; Y10T 292/707; E05B 65/0025; E05B 15/024; E05B 15/0245
USPC ..... 70/451
See application file for complete search history.

(56) References Cited

U.S. PATENT DOCUMENTS 365,152 A * 6/1887 Simson ..... E05B 55/005 70/448
839,556 A * 12/1906 Cuff ..... E05B 15/0245 292/341.18
887,817 A 5/1908 Keil
(Continued)

FOREIGN PATENT DOCUMENTS

CH 599437 A5 * 5/1978 ..... E05B 15/0245
CN 2440101 Y 7/2001
(Continued)

OTHER PUBLICATIONS

CN Office Action dated Mar. 13, 2019 re: Application No. 201510324524.0, pp. 1-9, citing: GB937563A and U.S. Pat. No. 4873853A.
(Continued)

*Primary Examiner* — Carlos Lugo
(74) *Attorney, Agent, or Firm* — Cantor Colburn LLP

(57) ABSTRACT

A fitting includes a functional lock part with a restraining area for a door element, and first and second fitting elements. Each of the fittings includes at least sectionwise a locating portion, which includes an intermediate layer able to contact the door element. The fitting elements delimit the restraining area. The functional lock part includes a third fitting element disposed between the first and second fitting elements. The fitting further includes an adjusting mechanism disposed between the fitting elements, with which a position alignment of the functional lock part can be performed.

9 Claims, 8 Drawing Sheets

(56) References Cited

U.S. PATENT DOCUMENTS 1,250,650 A * 12/1917 Pilchard ..... E05B 15/0245 292/341.19
2,153,080 A * 4/1939 Flora ..... E05B 15/0245 292/341.19
2,178,132 A 10/1939 Anderson
2,572,428 A * 10/1951 Anstine ..... E05B 15/0245 292/341.18
2,952,150 A * 9/1960 Matzkin ..... E05B 65/0025 70/451
3,107,113 A * 10/1963 Sconzo ..... E05B 15/02 292/228
3,702,549 A 11/1972 Solovieff et al.
4,171,836 A 10/1979 St. Aubin
4,456,290 A * 6/1984 Gross ..... E05B 65/0025 292/337
4,689,853 A * 9/1987 Marinoni ..... E05D 5/0246 16/382
4,873,853 A * 10/1989 Foshee ..... E05B 15/02 70/452
5,352,001 A * 10/1994 Shieh ..... E05B 15/025 292/341.18
6,058,746 A * 5/2000 Mirshafiee ..... E05B 63/0056 292/39
6,381,909 B1 * 5/2002 Liao ..... E05D 5/0246 49/388
7,441,428 B2 * 10/2008 Chang ..... E05B 55/06 292/139
7,588,272 B2 * 9/2009 Gephart ..... E05B 3/00 292/336.3
7,971,394 B1 * 7/2011 Dowling ..... E06B 3/70 49/506
8,161,779 B2 * 4/2012 Bergmann ..... E05B 65/0025 292/337
8,272,169 B2 * 9/2012 Mahdi ..... E05B 15/02 292/137
9,752,379 B2 * 9/2017 Aykas ..... E05D 7/081
9,856,693 B2 * 1/2018 Herth ..... E05D 7/081
2004/0221950 A1 * 11/2004 Mizusawa ..... E05F 11/385 156/272.4
2010/0050707 A1 * 3/2010 Liao ..... E05B 65/0025 70/91
2015/0043965 A1 * 2/2015 Mao-Cheia ..... E06B 3/5481 403/338

FOREIGN PATENT DOCUMENTS

CN 2727352 Y 9/2005
CN 201546561 U 8/2010
DE 4300810 A1 7/1994
DE 9402472 U1 6/1995
DE 202005015457 U1 2/2007
EP 0209845 A2 1/1987
EP 2163716 A2 3/2010
FR 1500507 A * 11/1967 ..... E05B 65/0025
GB 937563 A 9/1963
GB 1247848 A * 9/1971 ..... E05B 65/0025
WO 9521981 A1 8/1995

OTHER PUBLICATIONS

CN Office Action dated Jul. 30, 2018 re: Application No. 201510324524.0, pp. 1-9, citing GB937563A, EP0209845A2, CN2727352Y, CN2440101Y, U.S. Pat. No. 4171836A, CN201546561U.

Kenan Aykas "Fitting With Adjustable Restraining Area", re: Application No. 6244/CHE/2015 A, Aug. 31, 2016, Official Journal of The Patnet Office, Issue No. 36/2016.

* cited by examiner

FITTING WITH ADJUSTABLE RESTRAINING AREA

TECHNICAL FIELD

The present disclosure relates to a fitting with a functional lock part.

BACKGROUND

This species of fittings is mounted to both doors and windows and are supposed to feature a homogenous and visually appealing appearance throughout a fitting system. The mentioned fittings are in particular mounted to door elements, in particular glass doors, wherein the fittings need to be adapted to the respective leaf thicknesses, respectively to the glass or material thicknesses of the door elements, in particular of the glass door elements. Mostly, the structure of the prior art fittings comprises two fitting elements, which respectively include a locating portion for the door element, wherein an intermediate layer, which at least sectionwise, corresponds to the contour of the locating portions, is inserted between the locating portions and the door element. Outside the locating portions, the fitting elements form a free space within a cutout of the door element, which space serves for accommodating for example a lock insert. However, with the intention to be able restrain the door elements, in particular glass door elements, of different thicknesses between the prior art fitting elements, i.e. be able to restrain the door elements in the restraining area configured by means of the fitting elements, they are dimensioned such that in the delivery condition, i.e. in an initial position, they are able to accommodate just a door element having a different predetermined glass thickness. In the event, another glass door element having another glass thickness were to be accommodated, in the prior art fittings, the intermediate layer needs to be reinforced, which is interposed between the fitting elements and the door element, to compensate for the difference of the glass thickness. In this case, it is disadvantageous that by reinforcing the intermediate layers, the fitting elements abutting on both sides against the door element, move away from the door element. Together with the fitting elements, also the cover or covering elements, such as for example caps, which surround the fitting elements, respectively are placed on them, move away from the door element on both sides. Accordingly, a gap is created automatically on both sides of the door element, namely between the surfaces of the door element and the cover or covering element. In the event said gap creation were to be prevented, the cover or covering element on both sides of the door element would have to be exchanged against a deeper drawn cover or covering element, which then covers the gap formed by the reinforced intermediate layer. On the one hand this means, that in addition to intermediate layers of various thicknesses the prior art fittings need to be delivered with cover, respectively covering elements of various thicknesses, in order to adapt them to the glass door elements of various thicknesses, respectively to door leaf thicknesses, and on the other hand, it is disadvantageous that the construction depth of the prior art fittings is increased on both sides of the door element. In addition, it cannot be excluded that with thick configured intermediate layers the clamping of the fitting at the door element is reduced so much that the load bearing capacity, respectively the stability thereof is compromised.

Therefore, the disclosure overcomes the above-described disadvantages of the state-of-the-art at least partially. In particular, disclosure to the disclosure provides a fitting, which allows an enhanced adjustability, namely the adjustment to different door elements having various door leaf thicknesses, in particular having different glass thicknesses.

Disclosure

SUMMARY

The fitting with a functional lock part, in particular a lock insert or a lock casing or a lock strike box, with a restraining area for a door element, in particular for a glass door element, including a first fitting element and a second fitting element, which each include, at least sectionwise, a locating portion, which comprises an intermediate layer able to contact the door element, wherein the fitting elements delimit the restraining area, and wherein the functional lock part includes a third fitting element, which is disposed between the fitting elements, includes the technical teaching that an adjusting mechanism is provided between the fitting elements, which is able to perform a positioning alignment of the functional lock part.

This solution offers the advantage, that while maintaining the function of the fitting by means of the adjusting mechanism, a position alignment of the functional lock part is made possible within the fitting, wherein the distance of the fitting elements can be changed to the glass thickness of a door element restrained in the fitting, without the fitting elements moving away from the door element on account of a thicker intermediate layer. In other words, the distance of the fitting elements to the door element restrained between the fitting elements in the restraining area remains constant independently of the glass thickness, respectively door leaf thickness of the door element. This concept has the advantage that for example the respective frame or a cap, placed as a cover or covering element onto the fitting elements and surrounding the fitting elements always abuts against the glass door element independently of the glass thickness thereof. Insofar, the configuration of the inventive fitting with an adjusting mechanism, which allows for a position alignment of the functional lock part, prevents a gap formation between the fitting elements and the door element, independently of the door leaf thickness or the glass thickness of the door element. Automatically this means that the construction depth of the inventive fitting on both sides of the door element is always the same independently of the door leaf thickness or the glass thickness. As the functional lock part includes a third fitting element, the function of the fitting is infinitely variably adaptable. The third fitting element may be for example a strike plate, which will be position aligned via the adjusting mechanism and which forms the functional lock part configured as the counter strike box.

As the attaching means allows for variably adjusting the inventive fitting to the door leaf thickness, respectively the glass thickness of a door element clamped therein, in advantageous manner the thickness of the intermediate layer, which is disposed between the fitting elements and the door element, i.e. in the clamping, respectively restraining area of the inventive fitting, can always remain constant. Insofar advantageously, and independently of the door element with a variable thickness clamped with the inventive fitting, a constant stability of the fitting can be guaranteed.

Advantageously, the adjusting mechanism includes an adjusting element or a holding element embodied as an adjusting element, which is disposed between the fitting elements in such a way that a movement of the functional lock part can be performed orthogonally to the longitudinal extension of the fitting elements for the purpose of position alignment, or a movement of the functional lock part can be performed parallel to the longitudinal extension of the fitting elements for the purpose of position alignment. For performing a position alignment of the functional lock part parallel to the longitudinal extension of the fitting elements, at least one fitting element includes and preferably both fitting elements include a free space, in which the adjusting element or the holding element is movable, which is a structural component of the adjusting mechanism. According to the idea of the application, for example a recess, a slot or a groove is understood as a free space, which extends in longitudinal extension in at least one of the fitting elements. According to the idea of the disclosure, a distance created between the two fitting elements is also understood as a free space, which distance allows the adjusting element or the holding element, which advantageously include a head part and a connecting part and optionally a food part, to move with the connecting part between the fitting elements. In contrast thereto, the free space configured as a recess, which extends in longitudinal extension of the fitting elements, serves for supporting the holding element with its head part to be movable, respectively for coupling the holding element via the head part non-positively and/or positively to at least one fitting element.

In advantageous manner, the holding element is configured as an L-profile with a head part and a connecting part, preferably in the shape of two surfaces essentially orthogonally to each other, wherein the head part is supported in the free space configured as a groove, as a slot or as a recess in one of the fitting elements to be movable in the released condition of the adjusting mechanism, and in the fixing condition of the adjusting mechanism, acts in a clamping manner in the recess, and the connecting part is in operative connection with the connecting element. In the event both respective fitting elements each include a free space configured as a groove, as a slot or as a recess, the head part of the holding element, respectively the holding element is advantageously configured as a T-profile, for supporting the holding element to be movable in both recesses of the fitting elements, respectively for clamping it. By transferring the adjusting mechanism from its released condition into the fixing condition, the holding element configured as a T-profile on both sides, i.e. in both free spaces configured as a groove, a slot or a recess of the fitting elements, at least sectionwise, offers a resting surface, which serves for the non-positive and/or positive connection between the holding element and the fitting elements, i.e. in the fixing condition of the adjusting mechanism, the head part acts in a clamping manner in both grooves, slots or recesses. In contrast to the holding element configured as an L-profile, the holding element configured as a T-profile clamps equally on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. As already described for the holding element configured as an L-profile, in the holding element configured as a T-profile, the connecting element is connected to the holding element via a connecting part.

Advantageously, the adjusting element includes a head part, a connecting part and a foot part, wherein, via at least one fitting element; the adjusting element is connected by means of the foot part to the third fitting element. Advantageously, in this case, the head part and the connecting part are configured to be vertically to each other. Advantageously, in contrast thereto, the foot part is configured parallel to the head part and preferably together with the connecting part forms a monolithic and/or integral structural component.

In a particularly advantageous manner, the holding element and the connecting element being in an operative connection with the holding element via the connecting part, which is for example configured as a functional lock part in the shape of a lock strike box, are two interconnected structural components of the fitting. Preferably, said two structural components interconnected to form the adjusting mechanism, which is advantageously incorporated at both structural components, namely at the holding element and at the connecting element and which can be transferred between the released condition and the fixing condition, wherein the holding element is displaceable at the fitting elements in the released condition, and in the fixing condition, it is at least non-positively and/or positively attached to at least one fitting element. Accordingly, on the one hand, the adjusting mechanism formed at the holding element and at the connecting element serves for displacing the holding element and the connecting element connected to the holding element in relation to the fitting elements and in particular in relation to the longitudinal extension of the fitting elements. Moreover, the adjusting mechanism serves for positioning and for fixing the fitting and in particular the connecting element configured as a functional lock part, namely for at least non-positively and/or positively coupling the holding element via the adjusting mechanism to at least one of the fitting elements.

For establishing an operative connection between the holding element and the connecting element, i.e. for forming a variant of the inventive adjusting mechanism, the holding element and the connecting element are particularly advantageously non-positively and/or positively interconnected via at least one attaching element. The attaching element between the holding element and the connecting element may be for example a screw, such as e.g. a headless screw, which connects the holding element and the connecting element to each other. Particularly advantageously, at least two attaching elements are provided, which connect the holding element to the connecting element. The non-positive and/or positive connection between the holding element and the connecting element, i.e. the transfer of the adjusting mechanism from the released condition into the fixing condition, serves in addition in an advantageous manner for immobilizing the holding element at the attaching element. Preferably for this purpose, the attaching element includes a free space as a guide, for example in the shape of a recess, a groove or a rail, at which, respectively in which the holding element is guided, respectively supported to be movable. Advantageously, in this case, the free space in the fitting element is configured such that the holding element is displaceable, respectively guidable in longitudinal extension of the fitting element.

For performing a movement of the functional lock part orthogonally to the longitudinal extension of the fitting elements, the adjusting mechanism includes at least one coulisse disposed at the fitting element, at which coulisse the functional lock part is movable via the adjusting element. Preferably in this case, the coulisse extends between the fitting elements, namely into the distance between the fitting elements. In a preferred manner, two coulisses parallel to each other are disposed at the fitting, wherein preferably the coulisses are formed at one, even more preferred at both fitting elements and the functional lock part is movable via two adjusting elements in the two coulisses. In advantageous manner, the coulisse extends preferably at least sectionwise between the fitting elements, i.e. at least as far that the adjusting element is still guidable and clampable at the coulisse, if the door leaf thickness, respectively the glass thickness of the door element restrained between the fitting elements ranges between approximately 6 mm and 25 mm, preferred between 7 mm and 22 mm, and even more preferred between 8 mm and 17 mm.

Advantageously, the coulisse forms a common structural component with at least one fitting element. Preferably, in this case, the coulisse and the fitting element are configured integrally and/or as a monolithic structural component. In this case, for example a structural component manufactured in an injection molding process from one or more different components is understood as a monolithic structural component. However, a structural component manufactured from a material, which for example is milled from a metal block by machining a metal block, can be understood as an integral structural component. Preferably, a common structural component is also understood in that the coulisse and the fitting element are configured as individual parts, which are provided as a common structural component, namely as a fitting element in a pre-mounted condition with the coulisse.

Preferably, the adjusting element supported to be movable in the coulisse and is advantageously infinitely variably movable along the extension of the coulisse in the free space, which is configured as a distance between the fitting elements. Advantageously, the position alignment of the functional lock part can be performed in this case over the entire distance formed as a free space by the fitting elements. This embodiment of the inventive fitting supports in particular a compact construction type and a uniform construction depth independently of the material thickness of the door element clamped between the fitting elements.

Advantageously, the coulisse includes a free space in the shape of a recess configured as a slot or a groove, through which or in which the holding element is movable between the fitting elements. In this case, in advantageous manner the holding element is configured sectionwise as an L-profile or as a T-profile, preferably in the shape of two surfaces essentially orthogonally to each other, which form a head part and a connecting part, wherein the connecting part is supported to be movable in the free space configured as a groove, a slot or a recess in the coulisse in the released condition of the adjusting mechanism, and in the fixing condition of the adjusting mechanism, acts in a clamping manner in the recess.

Advantageously, the adjusting element or the holding element is attached to the functional lock part and/or to the third fitting element. The attachment is either realized via the connecting part configured at the adjusting element or at the holding element or at a foot part connected to the connecting part, wherein in advantageous manner, the foot part, the connecting part and the head part of the adjusting element, respectively the holding element are configured as a common, monolithic and/or integral structural component. In this case, for example a structural component manufactured in an injection molding process from one or more different components is also understood as a monolithic structural component. However, a structural component manufactured from a material, which for example is milled from a metal block by machining a metal block, can be understood as an integral structural component. Preferably, a common structural component is understood as well in that the head part, the connecting part and/or the foot part are configured as individual parts, which are provided as a common structural component, namely as the adjusting element, respectively the holding element in a pre-mounted condition with the coulisse.

For adjusting the adjusting mechanism, in particular for transferring the adjusting mechanism from the released condition into the fixing condition and vice versa, preferably, an attaching element is disposed to be accessible for a user from the outside, for example at a third fitting element configured as a strike plate for a functional lock part configured as a lock strike box. As the third fitting element is in operative connection with the adjusting element or the holding element, which is guided between the first and the second fitting elements in the coulisse, and the adjusting element or the holding element is thereby difficult to access, advantageously the adjusting mechanism can be manipulated via the attaching elements accessible from the outside at the third fitting element.

So that the adjusting element configured as a holding element is able to perform a stroke movement by means of the attaching elements disposed at the connecting element and accessible for the user preferably from outside, and for building the adjusting mechanism incorporated at the holding element, the holding element includes at least one bore, into which, in the fixing condition, the attaching element engages at least partially, whereby an increased clamping is caused between the holding element and the recess. Preferably, in the released condition, the attaching element engages far less deep into the bore or is located spaced apart from the bore, so that the clamping is weaker or the clamping is almost rescinded.

So that the attaching element is accessible from the outside for example at the strike plate, the third fitting element includes at least one through-hole, through which the attaching element extends as far as to the bore, and which is advantageously configured as a bore with internal thread.

As the internal thread of the through-hole serves as a thrust-bearing for the attaching element, which is preferably a screw, the adjusting element or the holding element are moved with the advance of the attaching element in the opposite direction to the advance of the attaching element. In this case, in particular the adjusting element, respectively the holding element guided in the recess of the coulisse reaches non-positive abutment against the recess. By tightening the attaching element, the head, in this case preferably a screw head, reaches thereby abutment against the through-hole configured in the third fitting element, whereby the adjusting element respectively the holding element is moved in relation towards the third fitting element, respectively the adjusting element or the holding element is moved in relation to the coulisse. By moving the adjusting element, respectively the holding element in relation to the coulisse, preferably, the adjusting element, respectively the holding element are non-positively and/or positively coupled to the coulisse.

Advantageously, the third fitting element and the functional lock part are configured as a monolithic and/or integral structural component. In this case, for example a structural component manufactured in an injection molding process from one or more different components is understood as a monolithic structural component. A structural component manufactured from a material, which component for example is carved out from the material block by milling, for example by machining a material block, for example a metal block, can be understood as an integral structural component. Preferably, a common structural component is also understood in that the fitting element and the functional lock part are configured as individual parts, which are provided as a common structural component in a pre-mounted condition.

With the intention to increase the clamping effect, i.e. the friction between the holding element, in this case, in particular here of the resting surface of the holding element and of the free space configured as a recess, here in particular the coulisse, in the area of the resting surface, preferably the holding element includes a profile, which may be for example a ribbing. In this case, the profile of the resting surface is configured in that the clamping respectively the friction between the holding element and the recess in addition to a non-positive connection guarantees a positive connection.

For utilizing the inventive fitting for accommodating a lock insert or a lock strike box, the fitting element disposed between the first and the second fitting elements includes at least one aperture, which is configured for the passage and/or the engagement of a functional element of a lock. In this case, a functional element of a lock can be understood as a dead bolt, which engages in the aperture of the fitting element, which according to the disclosure is disposed at an inventive fitting, which is configured as a lock strike box and serves for clamping for example at a double-leaf glass door. In the event a lock insert is accommodated in the inventive fitting in the reception area between the fitting elements, which is configured for example as an integral structural component with the fitting element disposed between the first and second fitting elements, preferably a dead bolt is understood as the functional element, which reaches through the aperture of the fitting element. However, for example also a mounting module, which reaches through the fitting element, namely through the aperture, intended for mounting a dead bolt or for example a latch bolt thereto, is understood as a functional element.

Advantageously, as already described, the adjusting element is configured as a holding element. Preferably in this case, the holding element is configured as an L-profile with a head part and a connecting part, preferably in the shape of two surfaces essentially orthogonally to each other, wherein the head part is supported in the free space configured as a groove, a slot or a recess in one of the fitting elements to be movable in the released condition of the adjusting mechanism, and in the fixing condition of the adjusting mechanism, acts in a clamping manner in the recess. In the event both fitting elements each include a free space configured as a groove, a slot or a recess, advantageously, the head part of the holding element, respectively the holding element is configured as a T-profile, for supporting the holding element to be movable in both recesses of the fitting elements, respectively for clamping it. By transferring the adjusting mechanism from its released condition into the fixing condition, the holding element configured as a T-profile on both sides, i.e. in both free spaces configured as a groove, a slot or a recess of the fitting elements, offers, at least sectionwise, a resting surface, which serves for the non-positive and/or positive connection between the holding element and the fitting elements, i.e. in the fixing condition of the adjusting mechanism, the head part acts in a clamping manner in both grooves, slots or recesses. In contrast to the holding element configured as an L-profile, the holding element configured as a T-profile equally clamps on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. In addition, the head part configured as a T-profile has the advantage that when rotating the holding element, the surface of one of the fitting elements rotated out of the free space is rotated into the free space of the other fitting element on the other side. As already described for the holding element configured as an L-profile, in the holding element configured as a T-profile, advantageously, the connecting element is connected to the holding element via a connecting part. In addition resting surfaces configured on both sides of the adjusting element configured as a holding element as a T-profile have the further advantage that the adjusting element is not only displaceable parallel to the fitting elements, but also between the fitting elements, i.e. displaceable, respectively movable towards the one or the other fitting element. Thereby, via the adjusting element configured as a holding element, not only the fitting can be adjusted in its height and to the glass thickness, but also for example to a plane offset between the inventive fitting configured as a lock strike box and for example a dead bolt to be introduced into the aperture of the fitting element. In addition, an angle offset between the dead bolt and the inventive fitting configured as a lock strike box can be compensated for, respectively adjusted by means of the advantageous embodiment of the adjusting element configured as a holding element.

For adjusting the inventive fitting to glass door elements or door elements having different thicknesses, advantageously, between the fitting elements, namely outside the locating portions, a distancing element adapted to the glass thickness can be disposed, which is configured as a counter-bearing to the locating portions and to the door element restrained between the first and second fitting elements. With the distancing elements, which are adaptable to the door element thickness, respectively the glass or material thickness, one and the same fitting is able to guarantee a consistent stability, independently of a glass door element with 8 mm glass thickness or a glass door element with 20 mm glass thickness being restrained between the fitting elements, because according to the disclosure the intermediate layer and in particular the thickness of the intermediate layer remains always the same. With the intention to configure not only a counter-bearing punctually via only one distancing element to the locating portions and to the door element restrained between the fitting elements, it is advantageous to dispose at least one second distancing element, which is placed almost parallel to the first distancing element. Advantageously in this case, the distancing element is non-positively and/or positively, in particular positively retained via at least one of its ends in a mount configured at the fitting element. With its other end, which is not retained in the mount, the distancing element preferably props up against the opposite fitting element or engages into the latter in a mount. The mount, which may be configured in one or in both fitting elements, is preferably an aperture, for example a bore, a pocket-bore or a milling, the contour thereof, i.e. the shape thereof, being preferably adapted to the exterior contour of the distancing element. If for example the distancing element is configured as a square element, for example in the shape of a square bar, the bore, respectively the milling is advantageously configured as a square hole or as a square milling, in which the square distancing element can be at least positively disposed, i.e. accommodated therein. Obviously, the distancing element may be configured as well in the shape of a round bar or for example in the shape of a hexagon bar, wherein then the bore, respectively the milling is advantageously adapted to the shape of the round bar, respectively to the shape of the hexagon bar. In this case, the configuration of the distancing element as a round stick, as a square or as a hexagon should not be understood as limiting, rather all contours oft the distancing element are conceivable, the exterior contour thereof being representable in the bore respectively the milling of the fitting element, so the distancing element can be positively accommodated therein.

Preferably, a frame can be placed onto the fitting elements, which surrounds them at least sectionwise and serves for example for disposing a cover or covering element, such as a cap. Preferably, the frame includes a border surrounding the fitting elements, the edge thereof abutting at least sectionwise flush against a door element restrained in the restraining area. Moreover, the border of the frame covers at least sectionwise the fitting element disposed between the first and second fitting elements, wherein the frame overlaps depending on the door element restrained between the first and second fitting elements. In the event for example a door element with 8 mm glass thickness is restrained in the restraining area between the first and second fitting elements, the overlapping of the border of the frame surrounding the fitting elements is larger over the fitting element disposed between the first and second fitting elements than if a glass door element for example with a glass thickness of 20 mm would be restrained between the fitting elements in the restraining area. In this case, namely with a glass door element of 20 mm glass thickness, the borders of the frames surrounding the fitting elements are moved away from each other, i.e. in opposite direction, via the fitting element disposed between the first and second fitting elements. This means, with constant distance between the fitting elements and the door element restrained therein, the distance of the borders of the frame surrounding the fitting elements changes depending on the glass thickness of the door element restrained in the restraining area between the fitting elements. In this case, the spacing of the borders of the frame increases or is reduced advantageously proportionally to the changing distance of the fitting elements to each other.

In the present application, the following terms are understood as not limiting, as follows:

A guide, at which the adjusting element respectively the holding element guided to be displaceable between the fitting elements or in the fitting elements, is understood as a "coulisse". In addition, the coulisse serves for connecting the fitting element, which is disposed between the first and second fitting elements, via the holding element non-positively and/or positively to the first and/or second fitting elements and to the third fitting element. In this case, the coulisse includes a free space configured as a recess in the shape of a groove, small channel, furrow, shoulder, rail or a protrusion. A coulisse according to the idea of the present disclosure may also be understood as a slot formed between two elements, wherein the two elements are configured orthogonally to the longitudinal extension of the fitting elements, and the slot is formed by the spacing of the elements to each other, in which the holding element can be guided. Obviously, latching means can be provided along the coulisse, which effect latching of the holding element and thus allow for a pre-adjustment of the fitting with regard to the positioning thereof at the door element or serve for the pre-adjustment of the fitting to a certain glass thickness. However, it might be that just latching and/or stop options are configured for standardized positions of the fitting.

A structural component, which is supported to be displaceable parallel with regard to the fitting elements and in particular serves for displacing the connecting element, which is operatively connected to the holding element, is understood as a "holding element". In this case, the holding element may be configured as a single-surface or multi-surface body. Obviously, the holding element may as well be configured of one or more struts connected to each other or otherwise, such as of an angled part. The space available between the fitting elements and formed by the distance of the fitting elements to each other is the only limiting factor for the type and construction form of the holding element.

A connecting element, which is in operative connection with the holding element, is understood as the "third fitting element, which is disposed between the first and second fitting elements". In this case, the connecting element should include an aperture, which serves for the passage, respectively engagement of a dead bolt. The fitting element configured as the connecting element may be in this case an integral and/or monolithic structural component configured with the holding element. In particular, the fitting element configured as a connecting element is suitable for an adjustable fitting, which is configured as a lock strike box.

A distancing element and preferably at least two or more distancing elements are understood as "distancing element". In this case, the one distancing element, respectively the distancing elements may be non-positively and/or positively, and in particular positively accommodated on both sides in mounts at the fitting elements and prop up on the other fitting element. Obviously, the distancing elements could be accommodated just in mounts at only one fitting element and would then prop up on the opposite fitting element or engage in the latter in mounts.

According to the idea of the present disclosure, a "fitting" is in particular a door fitting. The latter may be attached to a door element via a clamping. A door element is understood in particular as the door leaf itself. However, it is also possible to provide the static door element of an overall door system with an inventive fitting device. For example in addition to a pivoting module of a door system, namely the door leaf, it may also refer to an overpanel, a fixed module or a sliding module of the door system. In addition to conventional door leaves, the inventive fitting may find application in other pane-shaped structural elements, for example glass cabinets, balustrade glazings or shower stalls. The inventive fitting is in particular employed for door elements in glass construction type or partial glass construction type. Accordingly, the inventive fitting may also help perform a simplified manufacturing of said door element, respectively a simplified preparation of the door element for the use of the fitting. In this case, the clamping, respectively the restraining of the door element with the inventive fitting may be realized at the vertical or horizontal edges of the door element, respectively on the corner points thereof, or particularly preferred in the center part of the vertical edge of the door element, which is opposite the vertical edge adjoining the center of rotation.

BRIEF DESCRIPTION OF THE DRAWINGS

Hereinafter, further measures enhancing the disclosure will be illustrated in more detail in conjunction with the description of preferred embodiments of the disclosure based on the Figures.

In the drawings.

Throughout the different Figures, same parts are always identified by the same reference numerals, and therefore they will be normally only described once.

DETAILED DESCRIPTION OF THE DRAWINGS

Figure 1:
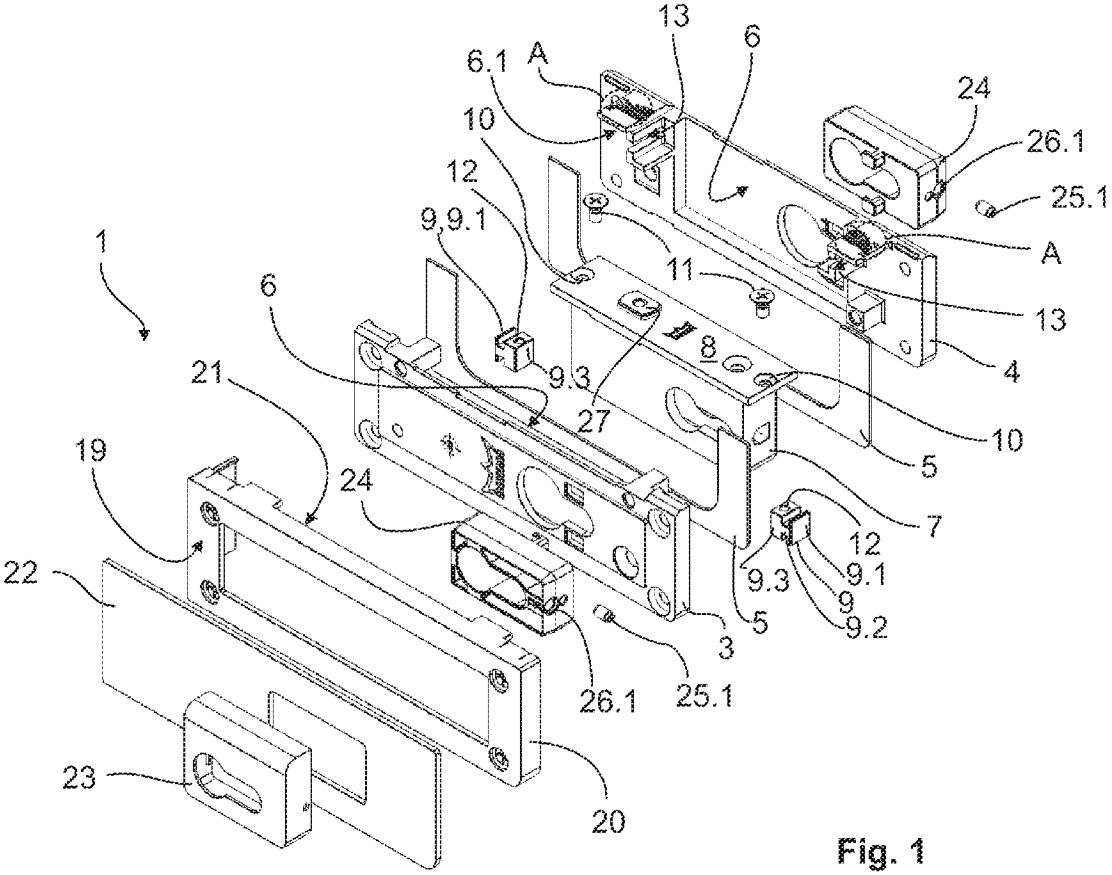
FIG. 1 shows an inventive fitting with a functional lock part configured as a lock insert for a profile cylinder in an exploded view.
Figure 6:
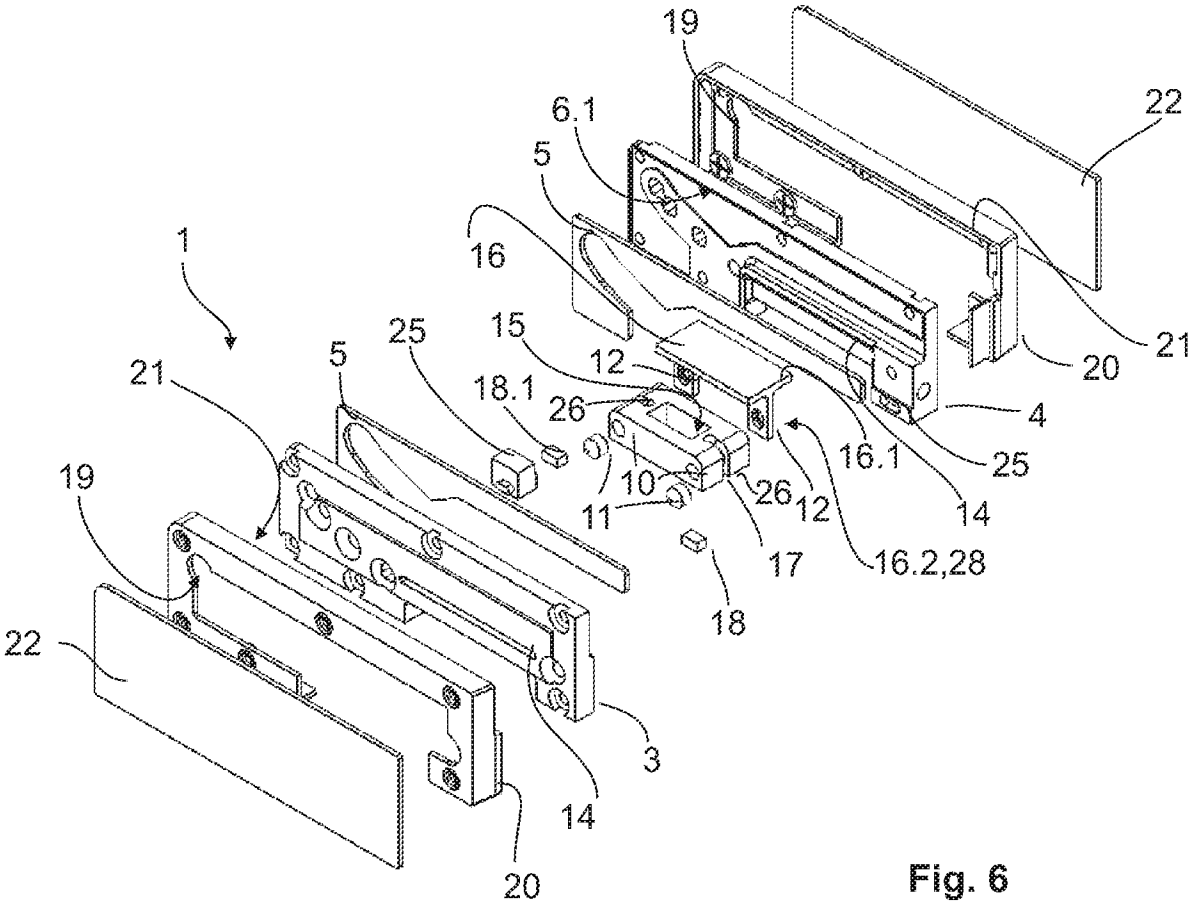
FIG. 6 shows a modified corner fitting, which is configured as the inventive fitting.

FIG. 1 shows an inventive fitting 1 with a functional lock part configured as a lock insert 7, wherein for the sake of illustration, the rear frame 19, which surrounds the fitting element 4, and the terminal cap 22, which can be fitted to the rear frame 19, and the cover element 23 for introducing a profile cylinder, as illustrated in FIG. 6, are not illustrated in FIG. 1. The fitting 1 comprises a restraining area 2 (illustrated for example in FIG. 2) for a door element and includes a first fitting element 3 and a second fitting element 4, which at least sectionwise include a locating portion 6.1, which comprises an intermediate layer 5 resting against the door element. In the mounted condition, the fitting elements 3 and 4 delimit the restraining area 2 for the door element and form a free space 6 configured as the reception area, which serves for example for receiving the lock insert 7.1. In the present case, the lock insert 7.1 is configured integrally with a third fitting or connecting element, which is disposed between the fitting elements 3 and 4 and connectable to them. The connection between the connecting element and the fitting elements 3 and 4 is realized via adjusting elements with a head part 9.1, a connecting part 9.2 and a foot part 9.3. The adjusting elements can be disposed, respectively are guidable in coulisses via the connecting part 9.2, which are configured at the fitting element 4. The coulisses extend between the fitting elements 3 and 4 at least sectionwise via the free space 6 configured as a reception area between the fitting elements 3 and 4, respectively via the space formed between the fitting elements 3 and 4. Via the adjusting elements, the fitting element can be non-positively and/or positively coupled, respectively connected to the fitting element 4 via the coulisse. For this purpose, the adjusting elements are introduced with the connecting part 9.2 into the coulisse configured as a slot (slit) and are attached at the head part 9.1 by means of attaching elements 11, which in the present case are configured as screws. For this purpose, the attaching elements 11 pass through through-holes 10 of the fitting element into a bore 12, which is respectively configured in the foot part 9.3 of the adjusting elements. In this case, the bore 12 is preferably configured as an internal thread bore, into which the attaching elements 11 configured as screws non-positively and/or positively engage. By screwing the attaching elements 11 in, respectively by tightening them, the adjusting elements are pulling in the direction of the fitting element and thereby clamp in the coulisse. This means that the fitting element is non-positively and/or positively connected to the fitting element 4 via the adjusting elements, namely in the coulisse configured at the fitting element 4. As the adjusting elements are guided, respectively supported to be displaceable in the coulisse of the fitting element 4, the fitting elements 3 and 4 can be spaced apart and adapted to the glass thickness of a door element, in this case without having to modify the thickness of the intermediate layer 5. This means that independently of the thickness of the door element, respectively of the glass or the material of the door element restrained in the restraining area 2, the material thickness of the intermediate layer 5 always remains constant such that the distance of the fitting elements 3 and 4 to the door element and thereby also the flush termination of the frame 19 surrounding the fitting elements 3 and 4, here in particular the flush termination at the edge 21 configured at the border 20 at the door element are maintained independently of the glass thickness of the door element.

In addition, via the adjusting elements, if required and allowed by the installation situation of the inventive fitting 1 at a door element, in particular at a glass door element, the lock insert 7.1 connected to the fitting element can be aligned centrally to the door leaf thickness of the door element and preferably centrally to the glass thickness of the glass door element. In this way, in a preferred manner, a homogenous appearance can be provided between the lock insert 7.1 and the door leaves used for the door element and in particular for the glass panes used for the glass door element.

At the fitting elements 3 and 4, at the side facing away from the reception area 6, an under-rosette 24 can be put, respectively attached thereto, which in the present case just like the fitting elements 3 and 4 have a cutout in the shape of a profile cylinder, which is adapted to the cutout in the lock insert 7.1 configured for a profile cylinder. The under-rosette 24 passes through the frame 19 and through the terminal cap 22, and on the terminal cap 22 it is surrounded by a cover element 23, in the present case by a rosette. In this case, also the cover element 23 configured as a rosette includes a cutout for a profile cylinder. The length of the profile cylinder not illustrated here is to be selected according to the length of the door leaf thickness of the door element, in this case in particular to the glass thickness of the glass door element restrained between the fitting elements 3 and 4, respectively to be adapted thereto. In the present case, threaded pins 25.1, which are configured in the shape of headless screws serve for supporting the under-rosette 24 at the profile cylinder and which engage in a bore 26.1 configured as an internal thread bore of the under-rosette 24 and reach abutment at the profile cylinder, which is not illustrated here. In the present case, the fitting element includes an aperture 15 for passing through a functional element of the lock insert 7.1 configured as a mounting module 27, to which for example a dead bolt can be mounted.

Figure 2:
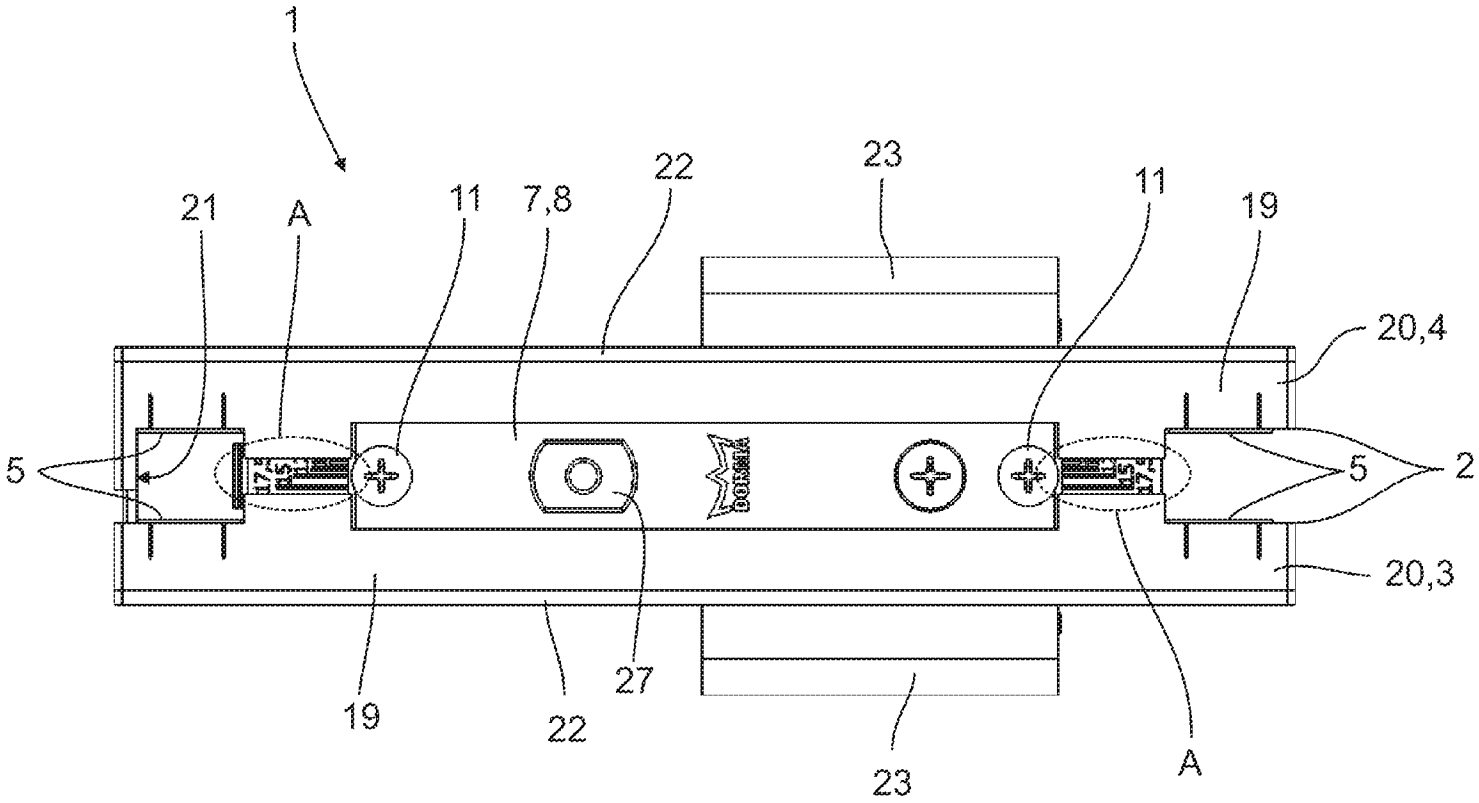
FIG. 2 shows the fitting of FIG. 1 in the mounted condition in a frontal view.

FIG. 2 shows the structural components of the inventive fitting 1 illustrated in Figure in a mounted condition in a frontal view. The fitting element is configured integrally with the lock insert 7.1 formed as a functional lock part 7, which here cannot be seen as it is illustrated behind the fitting element. The attaching elements 11, which connect the fitting element to the adjusting elements, are disposed to be accessible for a user from the outside. In the present case the attaching elements 11 configured as screws rest with their screw head in a terminal, respectively abutment position at the fitting element, whereby the adjusting elements are at least non-positively coupled in the coulisses of the fitting element 4. On the left and right sides of the fitting element, between the frame 19 and the fitting elements 3 and 4, a marking A provided on the coulisse can be seen. The marking A reads the adjustment of the fitting 1, namely the size of the restraining area 2. Insofar, the marking A allows for reading as well the door element thickness, in particular the glass thickness of a restrained glass door element. As can be seen in the frontal illustration of the fitting 1, the frame 19 with its border 20 overlaps the fitting element on both sides at least sectionwise, here in this illustration at the top and at the bottom. If the restraining area 2 is enlarged, i.e. the distance between the fitting elements 3 and 4 is widened, thus also the frames 19, which respectively surround the fitting elements 3 and 4 and are disposed on both sides at the fitting elements 3 and 4, are spaced apart from each other, and thereby reduce the sectionwise overlapping of the border 20 of the frame 19 over the fitting element, such that with an increasing restraining area 2 also a larger surface of the fitting element is revealed. In this case, with the spacing of the frames 19 with the fitting elements 3 and 4 also an increased area of the marking A is revealed.

Figure 3:
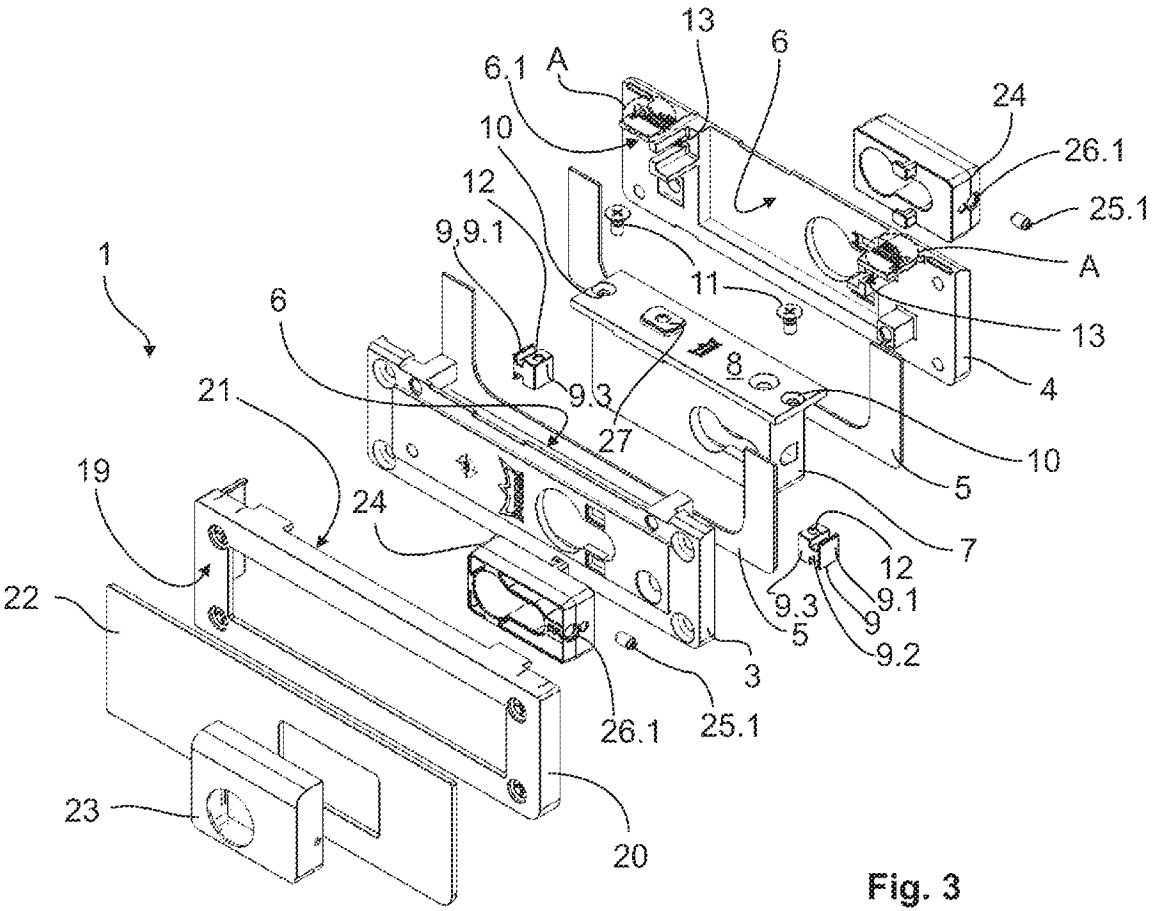
FIG. 3 shows the fitting of FIG. 1 with a modified cover element for installation into a round cylinder in an exploded view.

The structure of a fitting 1, as already illustrated in FIG. 1, is shown in FIG. 3. However, the fitting 1 illustrated in FIG. 3 does not serve for accommodating a profile cylinder, but for accommodating a round cylinder in the fitting 1. For this purpose, just the cover element 23 is exchanged, namely the rosette, which rests on the terminal caps 22. All other structural components remain the same, just like in the embodiment of the fitting 1 for accommodating a profile cylinder, as illustrated in FIG. 1. Insofar, with the simplified exchange of the cover element 23, namely the rosette with a reception for a round cylinder, the inventive fitting 1 can be configured for both accommodating a profile cylinder and for accommodating a round cylinder.

Figure 4:
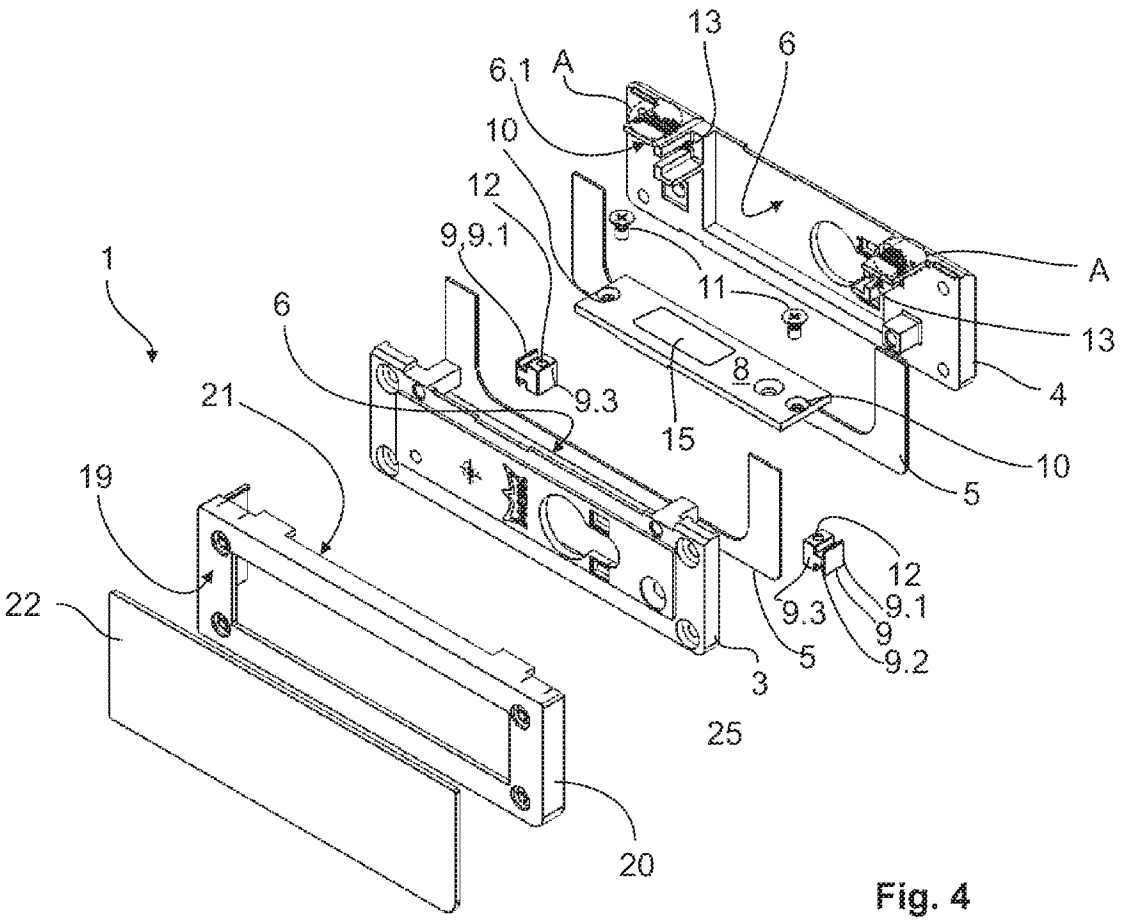
FIG. 4 shows the inventive fitting, which is configured as a lock strike box in an exploded view.

In FIG. 4 a functional lock part configured as a lock strike box is illustrated in an inventive fitting 1. A fitting element configured as a plate or a strike plate with a recess is disposed between the fitting elements 3 and 4 instead of the lock insert 7.1. In the event of clamping at a glass leaf door element, the recess 15 serves for passing through a dead bolt, respectively for accommodating the dead bolt between the fitting elements in the free space 6, formed by the glass cutout and by the fitting elements of the fitting 1 configured as a lock strike box. As can be seen, the configuration of the fitting 1 as a lock strike box does not require any other fitting elements 3 and 4 and compared to the fitting 1 illustrated in FIGS. 1 and 3. In addition, the under-rosettes 24 as well as the cover elements 23, namely the rosettes, are omitted. Just the terminal caps 22 differ from the fittings 1 illustrated in the FIGS. 1 and 3, namely in that they do not include any window and that the terminal caps 22 affixed to the frame 19 cover the entire full-face of the fitting elements 3 and 4.

Figure 5:
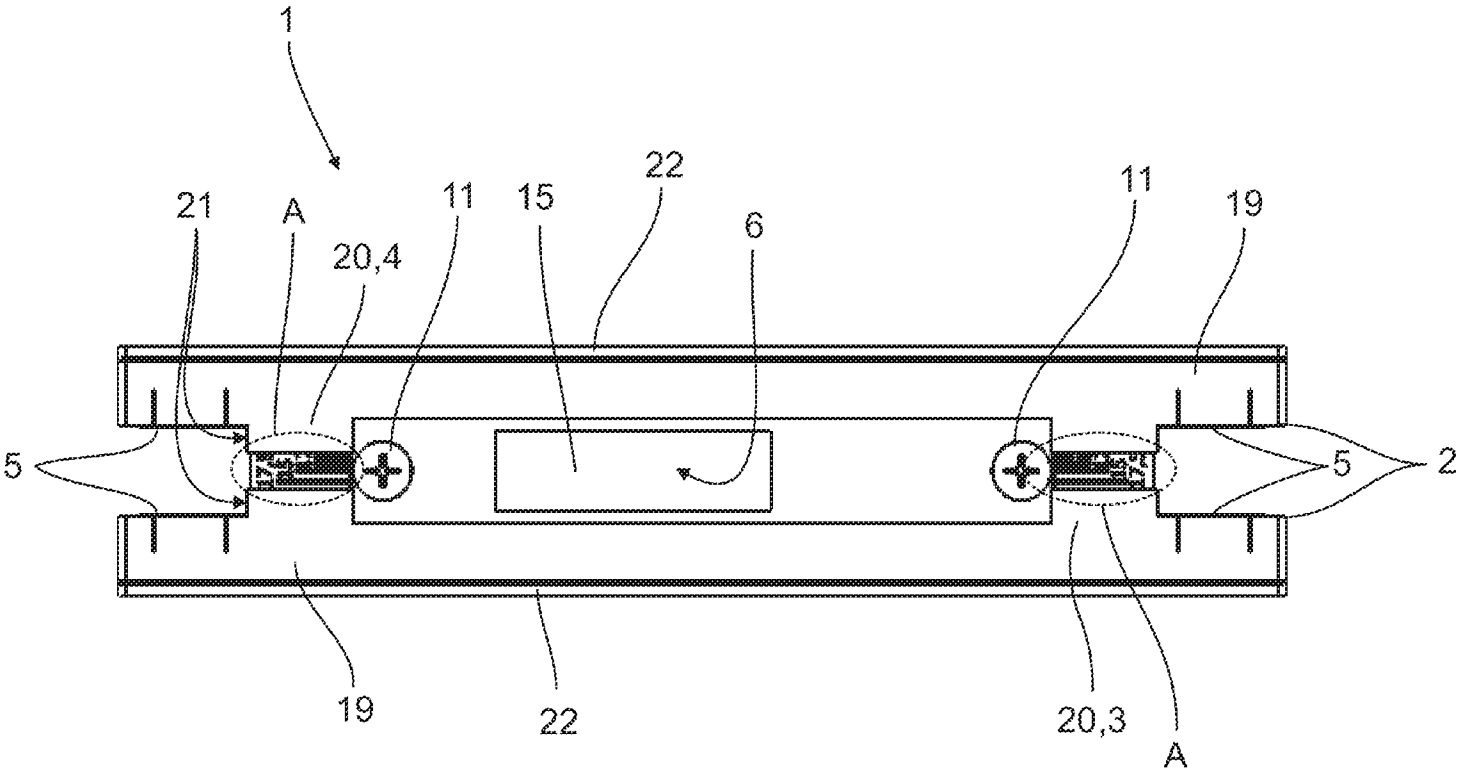
FIG. 5 shows the fitting of FIG. 4 in the mounted condition in a frontal view.

FIG. 5 shows the fitting 1 of FIG. 4 configured as a lock strike box in the mounted condition. The recess 15 allows for a view into the free space 6 configured as a reception area between the fitting elements 3 and 4.

FIG. 6 shows an inventive fitting 1, which is configured as a corner fitting with a functional lock part formed as a lock strike box. The fitting elements 3 and 4 are respectively surrounded by a frame 19, at which respectively one terminal cap 22 is attached. As the fitting elements 3 and 4 are preferably made from metal, metal allow or also for example from a plastic material metal alloy, the locating portions 6.1 comprise one intermediate layer 5 for each fitting element 3 and 4, which layer serves for the abutment of a door element against the fitting elements 3 and 4. As the door element is preferably a glass door element, on the one hand the intermediate layer 5 serves for preventing the contact of metal on glass. On the other hand, the intermediate layers 5 assist with the dampening properties of the inventive fitting 1. Said properties of the intermediate layer 5 are not only applicable to the here illustrated fitting 1 in FIG. 6, but also to the fittings 1 illustrated in the FIGS. 1 to 5. Respectively one mount 25, which serves for disposing, i.e. for inserting exchangeable distancing elements 18 and 18.1, is provided in the lower area of the fitting elements 3 and 4. In the fitting element 4, the mount 25 is a recess in the shape of a pocket hole, which serves at least for the positive accommodation or the arrangement of the distancing element 18. The mount 25 illustrated for the fitting element 3 for the distancing element 18.1 is configured as a separate structural component, which engages, respectively can be inserted for example into a bore, in particular into a pocket hole configured at the fitting element 3. The mount 25 of the fitting element 3, just like the mount 25 of the fitting element 4, has a recess, which serves for inserting, respectively for a positive connection to the exchangeable distancing element 18 or 18.1. With the intention to achieve a non-positive and/or positive connection between the fitting elements 3 and 4 and the fitting element, the fitting element is configured as a connecting element 17, which is operatively connected to the holding element 16, and together they form an adjusting mechanism, which is transferable from a fixing condition in a released condition and vice versa. In the present case, the connecting element 17 is non-positively and/or positively connected to the holding element 16 via two adjusting, respectively attaching elements 11. The holding element 16 being in operative connection with the connecting element 17 is guided to be movable in a coulisse in the fitting element 3 and the fitting element 4, which coulisse is configured as a free space in the shape of a recess 14, in the present case configured as a groove. In this case, the coulisse configured as a recess 14 respectively as a free space, is configured parallel to the longitudinal extension of the fitting elements 3 and 4. Thereby advantageously, the fitting element configured with the holding element 16 as a connecting element 17 is displaceable parallel to the longitudinal extension of the fitting elements with the adjusting element configured as a holding element 16. Correspondingly, the fitting element is also movable vertically to the longitudinal extension of the fitting elements in the distance formed as the free space 6 between the fitting elements 3 and 4. Thereby, the fitting element, in particular the aperture 15 thereof is adjustable to a dead bolt engaging therein. After aligning, respectively adjusting the fitting element, which is advantageously configured as a connecting element 17, via the holding element 16 the connecting element 17 is fixed in its position at least non-positively to the fitting elements 3 and 4 at the fitting elements 3 and 4.

As already described, attaching elements 11 and advantageously screws, which pass through through-holes 10 in the shape of bores 12 configured in the connecting element 17 serve for the non-positive and/or positive connection between the fitting element configured as a connecting element 17 and the adjusting element configured as a holding element 16. Advantageously, the through-holes 10 or bores 12 are configured as internal thread bores, into which the attaching elements 11 engage non-positively and/or positively after passing through through-holes 10.

In the present case, the holding element 16 and the connecting element 17 are configured as two interconnected structural components comprising an attaching mechanism, respectively the adjusting mechanism, which presently is incorporated into both structural components, namely in the holding element 16 and the connecting element 17. For transferring the adjusting, respectively the attaching mechanism form the released condition, in which the holding element 16 is supported to be movable in the longitudinal extension of the fitting elements 3 and 4 in the coulisse configured as a recess 14, into the fixing condition, the attaching elements 11, which connect the holding element 16 via the connecting part 16.2 to the connecting element 17, are screwed into the through-holes 10. When screwing the attaching elements 11 into the connecting part 16.2 of the holding element 16, the head part 16.1 of the holding element 16 at least sectionwise gets non-positively clamped in the coulisse, configured as a recess 14 in the shape of a groove or a slot, at the fitting elements 3 and 4. Thus, in the fixing condition of the adjusting, respectively the attaching mechanism, the displaceability of the holding element 16 and of the connecting element 17 operatively connected to the holding element 16 is disabled, by immobilizing the holding element 16 at the fitting elements 3 and 4.

In the present case, the connecting part 16.2 is configured with tappets 28. The tappets 28 have respectively one bore 12, through which the attaching elements 11 engage, which are guided in the through-holes 10 and thereby non-positively and/or positively connect the fitting element, namely here as illustrated the connecting element 17 to the holding element 16. The head part 16.1 of the holding element 16 situated vertically to the connecting part 16.2 includes at least one and in the present case respectively a resting surface on the left and right sides of the connecting part 16.2, which surface serves for guiding the holding element 16 in the coulisse, respectively the recess 14 configured as a groove in the fitting elements 3 and 4, and for non-positively coupling thereto. For assisting the non-positive coupling between the head part 16.1 and the coulisse configured as a recess 14, the resting surface of the head part 16.1 may include a ribbing, for example a diamond-shaped ribbing, which engages into a ribbing configured in the coulisses, such that in addition to the non-positive connection between the holding element 16 and the fitting elements 3 and 4 also a positive connection is provided in the fixing condition of the adjusting mechanism, respectively the attaching mechanism. Obviously, this embodiment of the holding element 16 is also applicable to the exemplary embodiments illustrated in FIGS. 1 to 5, wherein however, in particular the connecting part 16.2 of the holding element 16 guided in the coulisse includes for example a ribbing.

In the configuration of the inventive fitting 1 as a lock strike box, illustrated in FIG. 6, the maximum glass thickness of the door element restrained in the inventive fitting 1 and thereby the adjustment of the restraining area 2 to the leaf thickness of a door element is limited by the resting surface of the head part 16.1 of the holding element 16, because the latter, as described-above, is guided in the coulisses configured as recesses 14 of the fitting elements 3 and 4 and is non-positively and/or positively coupled to the recesses 14 via the attaching elements 11, which connect the holding element 16 to the fitting element configured as a connecting element 17.

Figure 7:
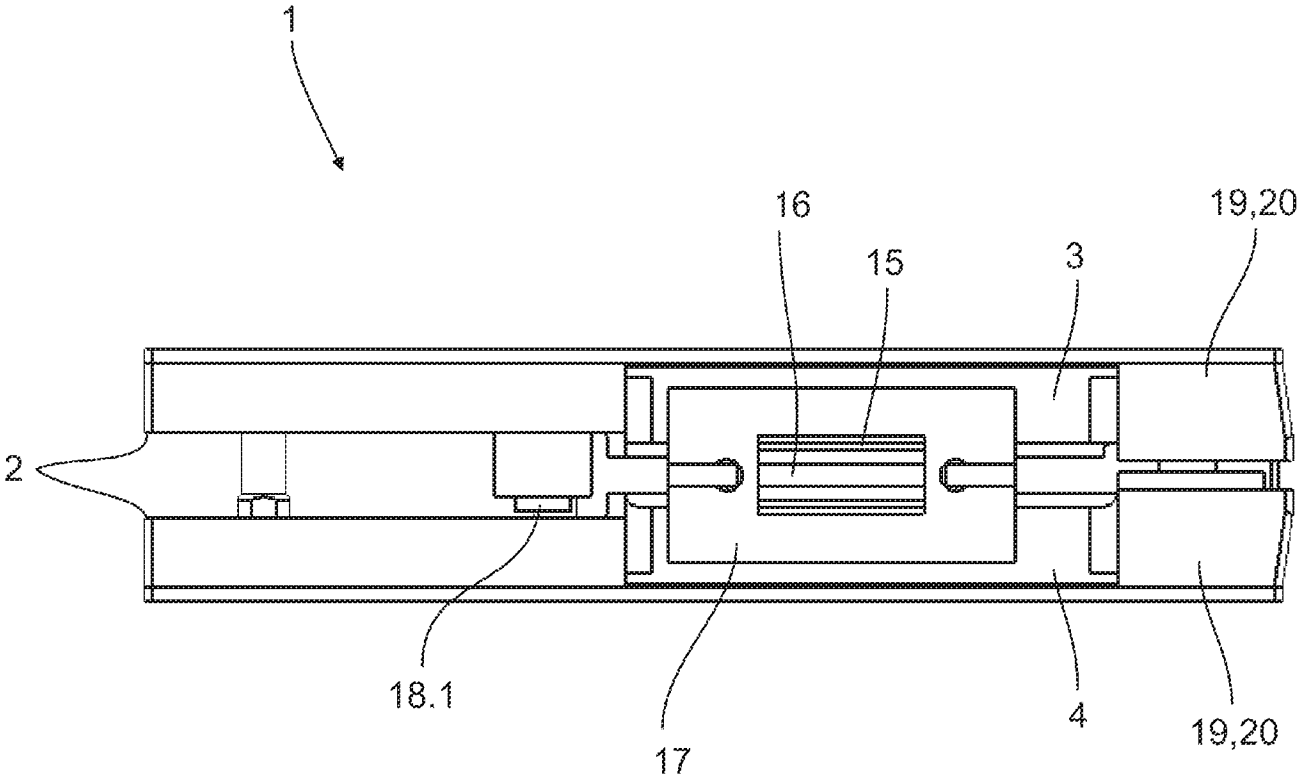
FIG. 7 shows the fitting of FIG. 6 in the mounted condition in a frontal view.

FIG. 7 shows the inventive fitting 1 of FIG. 6 in the mounted condition in a frontal view. As can be seen, the fitting element configured as a connecting element 17 and including an aperture 15 for the reception of a dead bolt, is displaceable between the fitting elements 3 and 4 with the holding element 16 at least sectionwise, here in the Figure to the left to the right, i.e. parallel to the fitting elements 3 and 4. In the event the fitting 1, in the present case configured as a lock strike box, is clamped for example at a vertical edge of a door element, the displaceability of the holding element 16 and the fitting element 17 operatively connected thereto allow for adjusting the aperture 15 configured in the fitting element 17 height variably to the engagement of a dead bolt. Insofar, with the here illustrated inventive fitting 1, a lock strike box can be realized, which is adjustable, i.e. here in particular variably height-adjustable at the vertical edge of a door.

Figure 8:
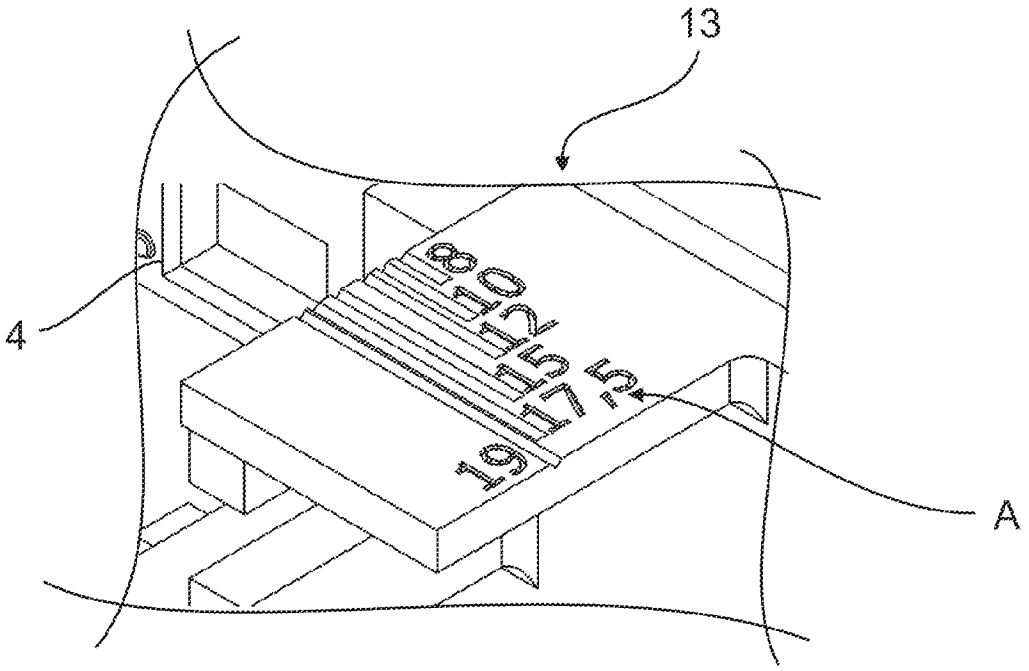
FIG. 8 shows a detailed view of the section A of FIGS. 1 to 5.

FIG. 8 shows a detailed view of the section A of FIGS. 1 to 5. The detailed view A is a marking configured on the coulisse. As can be seen, the marking shows indications in the millimeter range, and in the present case preferably indications to standardized glass door thicknesses. Said marking A is thus able to pre-adjust the inventive fitting 1 to the known door leaf thicknesses, in particular glass thickness of glass door elements.

The invention claimed is:

1. A fitting with a functional lock part, with a restraining area for a door element, including a first fitting element and a second fitting element, wherein the first fitting element and the second fitting element each include at least sectionwise a locating portion, which comprises an intermediate layer able to contact the door element, wherein the fitting elements delimit the restraining area, and wherein the functional lock part includes a connecting element disposed between the first and second fitting elements, wherein the connecting element defining opposed connecting slots, wherein an adjusting mechanism is provided between the fitting elements configured to align the functional lock part, wherein the adjusting mechanism comprises a base portion and a pair of fastening legs, each defining a bore, wherein the fastening legs are received in the connecting slots of the connecting element and a screw is received in each bore such that the adjusting mechanism is coupled to the connecting element, wherein the adjusting mechanism is configured such that the functional lock part is configured to move along a longitudinal extension of the first and second fitting elements for the purpose of position alignment, whereby a first recess is disposed in the first fitting element and a second recess is disposed in the second fitting element, and the first and second recesses are each in the shape of a slot or a groove configured to receive ends of the base portion of the adjusting mechanism, such that the adjusting mechanism connects the functional lock part to the first and second fitting elements and is supported to be displaceable in the first and second recesses, such that the adjusting mechanism is movable, wherein at least one mount is located in a pocket recess in one of the first and second fitting elements.

2. The fitting according claim 1, wherein the first and second fitting elements are adapted such that different material thicknesses of the door element can be inserted into the restraining area without having to modify the material thickness of the intermediate layer.

3. The fitting according to claim 1, wherein the recess forms a common structural component with at least one of the first and second fitting elements, such that the recess and the at least one fitting element are integral and/or form one monolithic structural component.

4. The fitting according to claim 1, wherein the adjusting mechanism is attached to the functional lock part and/or to the connecting element.

5. The fitting according to claim 1, wherein the connecting element and the functional lock part are configured as a monolithic and/or integral structural component.

6. The fitting according to claim 1, wherein the connecting element includes at least one aperture for the passage and/or engagement of a functional element of a lock.

7. The fitting according to claim 6, wherein the adjusting mechanism is in operative connection with the connecting element, at which an aperture is configured for the engagement of the functional element.

8. The fitting according to claim 1, wherein the adjusting element and the holding element include a head part, a connecting part and optionally a foot part, wherein the connecting element is connected to the connecting part via at least one attaching element, wherein the head part and the connecting part are aligned vertically to each other, and the foot part is aligned parallel to the head part and/or form a monolithic and/or integral structural component.

9. The fitting according to claim 1, wherein the adjusting mechanism is movable via the connecting part along the longitudinal extension of the fitting element in a free space in a first direction of movement, wherein the free space is configured such that the adjusting mechanism is movable in a second direction of movement parallel to the first direction of movement.

* * * * *